US005545265A

United States Patent [19]

Austin et al.

[11] Patent Number: 5,545,265

[45] Date of Patent: Aug. 13, 1996

[54] TITANIUM ALUMINIDE ALLOY WITH IMPROVED TEMPERATURE CAPABILITY

[75] Inventors: Curtiss M. Austin, Loveland; Thomas J. Kelly, Cincinnati, both of Ohio; Shyh-Chin Huang, Lapham, N.Y.

[73] Assignee: General Electric Company, Cincinnati, Ohio

[21] Appl. No.: 405,318

[22] Filed: Mar. 16, 1995

[51] Int. Cl.[6] ..... C22C 14/00

[52] U.S. Cl. ..... 148/421; 420/418; 420/421

[58] Field of Search ..... 148/421; 420/418, 420/421

[56] References Cited

U.S. PATENT DOCUMENTS

| | | | |
|---|---|---|---|
| 4,879,092 | 11/1989 | Huang | 420/418 |
| 5,028,491 | 7/1991 | Huang et al. | 428/614 |
| 5,076,858 | 12/1991 | Huang et al. | 420/421 |
| 5,324,267 | 6/1994 | Huang | 148/421 |

OTHER PUBLICATIONS

Austin et al., "The Effects of Al, Cr, Nb and Ta on Tensile Properties of Cast Gamma Titanium Aluminide", Titanium '92, The Minerals, Metals & Materials Society (1993), pp. 1065–1072.

Austin et al., "Development and Implementation Status of Cast Gamma Titanium Aluminide", Structural Intermetallics, The Minerals, Metals & Materials Society (1993), pp. 143–150.

*Primary Examiner*—John Sheehan

*Attorney, Agent, or Firm*—Andrew C. Hess; David L. Narciso

[57] ABSTRACT

A gamma titanium aluminide alloy is provided, based on the intermetallic compound TiAl, in which the resulting alloy is characterized by high creep strength and environmental resistance at elevated temperatures in excess of about 650° C., and as high as about 850° C. The alloy achieves these desirable properties through limited and interrelated additions of chromium, niobium and tantalum, whose combined amount is established by a minimum amount necessary to achieve a desired level of oxidation resistance.

15 Claims, 1 Drawing Sheet

TITANIUM ALUMINIDE ALLOY WITH IMPROVED TEMPERATURE CAPABILITY

The Government has rights to this invention pursuant to Contract No. N00140-90-C-1742 awarded by the Department of the Navy.

This invention relates to intermetallic alloys of titanium and aluminum that are relatively light weight and exhibit high strength and environmental resistance at elevated temperatures. More particularly, this invention relates to gamma titanium aluminide alloys based on the intermetallic compound TiAl, with controlled additions of chromium, niobium and tantalum for promoting castability and enhancing environmental resistance and creep strength at temperatures in excess of about 650° C.

BACKGROUND OF THE INVENTION

As the material requirements for gas turbine engines continually increase, considerable emphasis has been placed on improved alloys characterized by relatively low densities and high strength at elevated temperatures. Titanium-based alloy systems have been developed as a result of this requirement, with notable success occurring with titanium intermetallic systems based on the titanium aluminide TiAl (gamma). Gamma titanium aluminide alloys typically contain aluminum in amounts between about 46 to about 52 atomic percent, and are generally characterized as being relatively light weight, yet exhibiting high temperature strength, stiffness and burn resistance. As such, considerable effort has been directed toward evaluating these gamma titanium aluminide alloys for aerospace structural components which have been typically formed from nickel or titanium alloys.

Generally, gamma titanium aluminide alloys (also referred to as gamma alloys) exhibit relatively low ductility and low fracture toughness at room temperature, making these alloys difficult to process. In addition, unless properly alloyed, gamma alloys do not exhibit desired high oxidation resistance due to their tendency to form titanium dioxide ($TiO_2$) rather than aluminum oxide ($Al_2O_3$) at high temperatures. For example, the oxidation limit for a gamma alloy is often significantly less than its creep limit. Accordingly, a common objective with the use of titanium aluminide alloys is to achieve a good balance between mechanical properties at both room temperature and elevated temperatures, and environmental characteristics such as oxidation resistance.

U.S. Pat. No. 4,879,092 to Huang, assigned to the same assignee of the present patent application, teaches a gamma titanium aluminide alloy whose composition is nominally, in atomic percent, 48 percent aluminum, 2 percent chromium and 2 percent niobium, with the balance being titanium and incidental impurities (48Al—2Cr—2Nb). This alloy exhibits strength and environmental resistance comparable to nickel alloy Alloy 718 at the upper temperature limit of Alloy 718. Furthermore, the 48Al—2Cr—2Nb alloy exhibits about fifty percent greater specific stiffness than conventional titanium and nickel alloys. As such, the alloy taught by Huang meets the requirements of many structural components for gas turbine applications.

The alloy taught by Huang is directed primarily toward wrought processing. As is well known in the art, wrought gamma alloys inherently have microstructural features that differ significantly from gamma alloys that have been processed by casting. Such differences directly affect such properties as strength, ductility, creep resistance and fracture toughness. While the 48Al—2Cr—2Nb alloy taught by Huang has been identified as having desirable properties in wrought form, this alloy does not fully exploit the unique properties of gamma alloys for cast applications.

Research directed toward TiAlCrNbTa gamma alloys has been reported by Austin and Kelly in "Development and Implementation Status of Cast Gamma Titanium Aluminide", Structural Intermetallics, The Minerals, Metals & Materials Society (1993). While this research generally indicated that chromium, niobium and tantalum content had an effect on the ductility of a gamma alloy, nothing was reported as to their effects on creep strength, which is a key concern for components subjected to stresses while operating at high temperatures. Notably, little is known or taught in the prior art concerning creep effects of chromium, niobium and tantalum on gamma alloys.

Accordingly, it would be desirable to provide a gamma titanium aluminide alloy whose chemistry is optimized for cast applications, and is characterized by elevated temperature strength and environmental resistance, enabling cast components to operate at temperatures higher than that possible with prior art gamma alloys. It would be particularly desirable if the creep strength of a gamma titanium aluminide alloy were optimized in order to permit castings formed from such an alloy to be used as gas turbine engine structural components that are subjected to temperatures of 650° C. and more, yet are required to maintain their dimensional tolerances.

SUMMARY OF THE INVENTION

It is an object of this invention to provide a gamma titanium aluminide intermetallic alloy that exhibits both sufficient mechanical properties and environmental capabilities so as to be suitable for use as structural components in high temperature applications, such as that found in gas turbine engines.

It is a further object of this invention that such an alloy include alloying additions which improve the strength and environmental resistance of the alloy at elevated temperatures.

It is another object of this invention that such an alloy utilize chromium, niobium and tantalum in limited and interrelated amounts, such that suitable oxidation resistance and creep strength are achieved at temperatures of up to about 850° C.

It is yet another object of this invention that such an alloy be optimized for cast processing.

It is still a further object of this invention that such an alloy be responsive to heat treatments.

The present invention provides a gamma titanium aluminide alloy, based on the intermetallic compound TiAl, in which the resulting alloy is characterized by high creep strength and environmental resistance at elevated temperatures in excess of about 650° C., and as high as about 850° C. The alloy of this invention achieves these desirable properties through limited and interrelated additions of chromium, niobium and tantalum, whose combined amount is established by a minimum level necessary to achieve a desired level of oxidation resistance.

The gamma titanium aluminide intermetallic alloy, or gamma alloy, of this invention is characterized by, in atomic percent, an aluminum content of about 45 to about 49 percent and preferably about 46.5 to about 47.8 percent aluminum, a chromium content of about 1.2 to about 2.3 percent and preferably about 1.7 to about 1.9 percent, a niobium content of about 0.5 to about 2 percent and preferably not more than about 0.9 percent, and a tantalum content of about 1 to about 2.3 percent and preferably not more than about 2 percent, with the balance being essentially titanium and incidental impurities. The gamma alloy of this invention is further characterized by the sum of the chromium, niobium and tantalum (Cr+Nb+Ta) constituents being at least about 3.5 atomic percent, and preferably at least about 4.1 atomic percent but not more than about 4.9 atomic percent. To achieve this sum, the alloy preferably contains about 0.7 to about 0.9 percent niobium and about 1.7 to about 2 percent tantalum.

While the gamma alloy of this invention may be produced in cast or wrought form, the alloy is particularly suited for production of structural components by casting methods. Castings of the gamma alloy can be hot isostatic press (HIP) densified and, where appropriate, heat treated to enhance the mechanical properties of the alloy, such as creep resistance and ductility.

Generally, cast components produced from the preferred gamma alloy exhibit excellent metallurgical stability, suitable ductility and fracture toughness at lower temperatures, and excellent creep strength and oxidation resistance at temperatures in excess of 650° C. and as high as about 850° C. In particular, the gamma alloy of this invention exhibits superior creep strength as compared to prior art gamma alloys, including the gamma alloy taught by U.S. Pat. No. 4,879,092 to Huang.

Such a desirable property is a result of the highly selective and limited additions of chromium, niobium and tantalum whose alloying amounts, when appropriately balanced, promote the creep strength of the gamma alloy, as well as the fracture toughness, oxidation resistance, and castability of the alloy. As a result, the gamma alloy of this invention is suitable for forming cast structural components for use in more demanding applications than possible before, including intermediate stages of a low pressure turbine section of a high-bypass gas turbine engine, and where components are required to maintain their dimensional tolerances at elevated temperatures while subjected to stresses.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing, in which an improvement in creep strength is graphically illustrated for the gamma titanium aluminide intermetallic alloy of this invention, as compared to prior art gamma titanium aluminide intermetallic alloys.

DETAILED DESCRIPTION OF THE INVENTION

Figure 1:
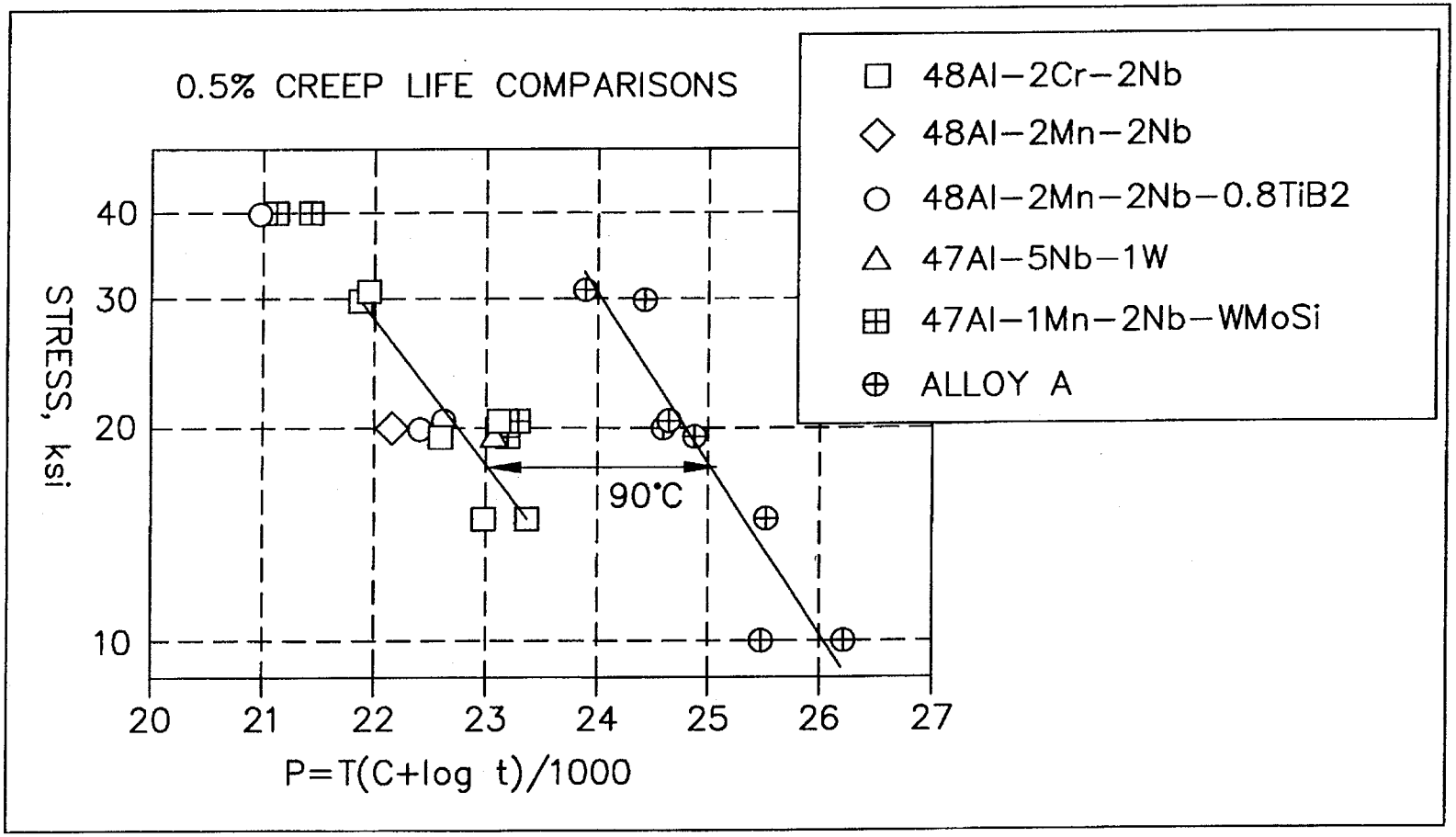

A titanium aluminide alloy is provided based on the intermetallic compound TiAl, conventionally known as gamma titanium aluminide alloys, or gamma alloys. The gamma alloy of this invention includes alloying additions that, in accordance with this invention, enable the alloy to exhibit mechanical and environmental properties that permit components formed from the alloy to be used in high temperature structural applications, such as a gas turbine engine.

For example, the gamma alloy of this invention is particularly suited for forming such cast components as turbine airfoils and structures in a low pressure turbine section of a high-bypass gas turbine engine, where temperatures in excess of 650° C. can be sustained, yet the components are required to maintain their dimensional tolerances.

The gamma titanium aluminide alloy of this invention has a nominal composition, in atomic percent, of about 47.15 percent aluminum, about 1.8 percent chromium, about 0.8 percent niobium, and about 1.85 percent tantalum, with the balance being titanium and incidental impurities.

A suitable range for the aluminum content is about 45 to about 49 atomic percent, with a preferred range of about 46.5 to about 47.8 percent. These ranges are based on aluminum's effect on ductility, toughness and creep resistance. The low end of the preferred range is based on minimum requirements for ductility and creep strength, while the upper end of the preferred range is based on toughness as well as ductility and creep. The preferred range represents a preference for creep resistance over tensile strength.

A suitable range for chromium is about 1.2 to about 2.3 atomic percent, with a preferred range of about 1.7 to about 1.9 percent. These ranges represent an effort to maximize the content of chromium without adversely effecting the fracture behavior of the gamma alloy. Surprisingly, it was determined that chromium was strongly beneficial to creep resistance within the gamma alloy of this invention, up to a point where the detrimental influence on fracture behavior become predominant. It was found that ductility, castability and toughness fell rapidly if a chromium content of more than 2 percent was used, as a result of the formation of the B2 phase, an ordered chromium-rich intermetallic compound.

The preferred range for chromium was determined to maximize creep strength and oxidation resistance without causing a significant loss of ductility. The lower limit of this range was determined so as to preserve creep strength. This minimum amount of chromium appears to preserve creep strength by causing a slight oversaturation of chromium within the alloy chemistry which thereby promotes precipitation of Cr-rich particles. The upper end of the chromium range is selected so as to optimize the ductility, castability, and toughness properties of the alloy. These properties tend to diminish beyond the preferred chromium upper limit for this alloy.

Niobium is present in the gamma alloy within a range of about 0.5 to about 2 atomic percent, with a preferred range of about 0.7 to about 0.9 percent. While niobium is often present in gamma alloys for the purpose of enhancing oxidation and creep resistance, it was determined that conventionally used levels of niobium had a detrimental effect on creep in conjunction with the presence of chromium and tantalum. Accordingly, the level of niobium for the gamma alloy of this invention was limited to have a minimal adverse effect on creep strength, ductility and toughness, but at a level sufficient to contribute to oxidation resistance.

The final primary alloying constituent of the gamma alloy is tantalum, present in amounts of about 1 to about 2.3 atomic percent, and preferably within a range of about 1.7 to about 2 percent. Tantalum is present primarily to enhance creep and oxidation resistance, with the added effect of improving strength. Though tantalum has an adverse effect on ductility and toughness, it was determined that creep resistance versus tantalum content exhibited a broad peak between one and two percent. Accordingly, the preferred tantalum content of the gamma alloy of this invention was selected to be just beyond this peak in order to secure tantalum's desirable effect on creep properties, yet provide adequate ductility and toughness.

Finally, in accordance with this invention, it was determined that the relative amounts of chromium, niobium and tantalum in the gamma alloy had a significant effect on the surface stability of the alloy, particularly in terms of oxidation resistance. Specifically, it was determined that a chromium, niobium and tantalum content (Cr+Nb+Ta) of at least 3.5 atomic percent, and more preferably 4.1 atomic percent, was necessary to achieve suitable oxidation resistance with respect to the preferred chromium content of this invention. It was further determined that a consistent improvement in oxidation resistance was achieved as the sum increased to a level commensurate with the maximum preferred levels noted above for chromium, niobium and tantalum—i.e., a Cr+Nb+Ta content of up to about 4.9 atomic percent. Finally, it was determined that, within the alloying range dictated by the above, the gamma alloy of this invention exhibited useful creep strength and bare oxidation resistance at temperatures in excess of about 650° C., and up to about 850° C.

As can be seen from the above, the preferred ranges for the principal alloying constituents of this invention are each within well defined ranges that have been determined to uniquely achieve desirable properties for a cast component operating within a high temperature environment. Accordingly, the alloying ranges of the gamma alloy of this invention are a considerable refinement of trends reported by Austin and Kelly, particularly in that the effects of chromium, niobium and tantalum on creep strength have been established, enabling a formulation in which a balance is attained among these alloying elements in order to achieve both desirable mechanical and environmental resistance properties.

In accordance with this invention, preferred ranges also exist for impurity elements, whose levels are generally within conventional ranges, but the levels may be tailored in response to the requirements of a particular application. Specifically, the gamma alloy preferably contains about 1000 to about 3000 parts per million (ppm, atomic percent) oxygen, up to about 500 ppm iron, up to about 600 ppm nitrogen, up to about 2200 ppm silicon, and up to about 1000 ppm carbon. Oxygen is beneficial to tensile strength and fracture toughness, but is deleterious to ductility at high levels. Carbon and silicon are known to improve creep resistance, but at an unacceptable cost to ductility and fracture toughness. Therefore, higher levels of these elements may be favored if reduced fracture properties are acceptable.

In addition to the above, it was determined that maximum creep resistance and ductility is achieved with the gamma alloy of this invention through the use of lower temperature HIPing and heat treatments. For example, a suitable HIP temperature is about 1175° C. to about 1260° C., and a suitable heat treatment temperature is about 980° C. to about 1200° C. Particularly suitable HIP and heat treatments for the gamma alloy of this invention are disclosed in U.S. patent application Ser. Nos. 08/262,168 and 08/262,178, both of which are assigned to the assignee of this invention. Higher temperatures could be employed with this alloy in order to achieve greater toughness to the detriment of creep strength, and yet produce a component whose creep characteristics remain superior to prior art gamma alloys that have been similarly processed.

The microstructural characteristics of the gamma alloy of this invention are similar to those of other cast gamma alloys in terms of solidification path and microstructural evolution. The preferred HIP and heat treatment processing yields a duplex microstructure composed of gamma grains plus lamellar grains, the latter composed of layers of gamma plates with twin-related interfaces and occasional plates of the alpha-two ($Ti_3Al$) phase. The resulting structure may vary between mostly gamma grains and mostly lamellar grains. This invention's preferred aluminum, chromium, niobium and tantalum ranges take such potential variations into account.

The dramatic improvement in creep strength achieved with the gamma alloy of this invention is illustrated in the Figure, which is a plot of the Larson-Miller parameter versus stress for a 0.5 percent creep strain. As is known in the art, the Larson-Miller parameter "P" is calculated as:

$$P=T(C+\log t)/1000$$

where T is the test temperature in degrees Kelvin, C is a constant whose value is approximately 20 for titanium-base alloys, and t is the rupture time in hours. The Larson-Miller parameter is employed in the art to correlate stress, temperature and rupture time for the purpose of comparing mechanical properties at elevated temperatures, and therefore can be used to determine a relationship between temperature-influenced creep life capability and stress.

The gamma alloy of this invention (Alloy A) was tested against known gamma titanium aluminide alloys, including the 48Al—2Cr—2Nb alloy taught by Huang, as well as gamma alloys having the nominal chemistries indicated in the Figure. All alloys were cast and given a heat treatment that optimized their creep properties.

As can be seen in the graph, the creep life capability of the gamma alloy of this invention exceeded that of the other gamma alloys, with the difference in temperature capability being approximately 90° C. Notably, this dramatic increase in creep properties was achieved without significant loss in other mechanical properties.

The above results indicate that many high temperature structural components can be improved if the gamma alloy of this invention is substituted for known gamma alloys, such as those represented in the Figure. In particular, the data depicted in the Figure indicates that structural components that must operate at temperatures in excess of about 650° F., such as low pressure turbine airfoils, cases and frames, would benefit from the use of the gamma alloy of this invention. For example, while prior art gamma alloys may potentially be employed in the last two stages of a low pressure turbine of a high-bypass gas turbine engine, the gamma alloy of this invention can be used to form structural components for the preceding two stages of the same low pressure turbine.

In addition, the dramatic improvement in creep properties achieved by the gamma alloy of this invention permits its use to form components that must operate at elevated temperatures while maintaining their dimensional tolerances, such as turbine frames and cases. In contrast, prior art gamma alloys such as those represented in the Figure have inadequate creep properties for such severe applications.

From the above, it can be seen that the gamma titanium aluminide alloy of this invention can be employed to produce cast components that exhibit excellent metallurgical stability, suitable ductility and fracture toughness at lower temperatures, and excellent creep strength and oxidation resistance at temperatures in excess of 650° C., and as high as about 850° C. The gamma alloy of this invention particularly exhibits superior creep strength as compared to prior art gamma alloys, through highly selective, balanced and limited additions of chromium, niobium and tantalum.

In accordance with this invention, the alloying amounts of chromium, niobium and tantalum, when alloyed at an appropriate level, yields an alloy having greatly increased creep strength. As a result, the gamma alloy of this invention is suitable for forming cast structural components for use in more demanding applications than possible before.

While our invention has been described in terms of a preferred embodiment, it is apparent that other forms could be adopted by one skilled in the art. For example, while the gamma alloy of this invention is particularly alloyed for the production of structural components by casting methods, components can also be produced from the alloy in wrought form. In addition, the gamma alloy may be modified with boron, titanium diboride and/or tungsten for the purpose of increasing certain mechanical properties. Accordingly, the scope of our invention is to be limited only by the following claims.

What is claimed is:

1. A gamma titanium aluminide intermetallic alloy consisting essentially of, in atomic percent:

about 45 to about 49 percent aluminum;

about 1.2 to about 2.3 percent chromium;

about 0.5 to 0.9 percent niobium; and about 1 to about 2.3 percent tantalum;

the balance being essentially titanium and incidental impurities;

wherein (Cr+Nb+Ta) is at least about 3.5 percent but not more than about 4.9 percent.

2. An alloy as recited in claim 1 wherein the alloy contains, in atomic percent, about 46.5 to about 47.8 percent aluminum and about 1.7 to about 1.9 percent chromium.

3. An alloy as recited in claim 1 wherein the alloy contains, in atomic percent, about 1.7 to about 2 percent tantalum.

4. An alloy as recited in claim 1 wherein (Cr+Nb+Ta) is at least about 4.1 percent.

5. An alloy as recited in claim 1 wherein the alloy further contains about 1000 to about 3000 ppm oxygen.

6. An alloy as recited in claim 1 wherein the alloy further contains not more than about 500 ppm iron, not more than about 600 ppm nitrogen, not more than about 2200 ppm silicon, and not more than about 1000 ppm carbon.

7. An alloy as recited in claim 1 wherein the alloy further contains boron or titanium diboride.

8. An alloy as recited in claim 1 wherein the alloy further contains tungsten.

9. A gamma titanium aluminide intermetallic alloy consisting essentially, in atomic percent, of:

about 46.5 to about 47.8 percent aluminum;

about 1.7 to about 1.9 percent chromium;

about 0.7 to about 0.9 percent niobium;

about 1.7 to about 2 percent tantalum;

about 1000 to about 3000 ppm oxygen;

not more than about 500 ppm iron;

not more than about 600 ppm nitrogen;

not more than about 2200 ppm silicon; and not more than about 1000 ppm carbon;

the balance being essentially titanium and incidental impurities;

wherein (Cr+Nb+Ta) in at least about 3.5 percent but not more than about 4.9 percent.

10. A cast component formed from a gamma titanium aluminide intermetallic alloy consisting essentially of, in atomic percent:

about 45 to about 49 percent aluminum;

about 1.2 to about 2.3 percent chromium;

about 0.5 to 0.9 percent niobium; and about 1 to about 2.3 percent tantalum;

the balance being essentially titanium and incidental impurities;

wherein (Cr+Nb+Ta) is at least about 3.5 percent but not more than about 4.9 percent.

11. A cast component as recited in claim 10 wherein the alloy contains, in atomic percent, about 46.5 to about 47.8 percent aluminum and about 1.7 to about 1.9 percent chromium.

12. A cast component as recited in claim 10 wherein the alloy contains, in atomic percent, about 1.7 to about 2 percent tantalum.

13. A cast component as recited in claim 10 wherein (Cr+Nb+Ta) is at least about 4.1 percent.

14. A cast component as recited in claim 10 wherein the cast component has a maximum service temperature in excess of 650° C.

15. A cast component as recited in claim 10 wherein the cast component is employed in an intermediate stage in a low pressure turbine section of a high-bypass gas turbine engine.

* * * * *